US010427200B2

(12) United States Patent
Hayashi et al.

(10) Patent No.: US 10,427,200 B2
(45) Date of Patent: Oct. 1, 2019

(54) MOLD FIXING STRUCTURE

(71) Applicants: DAIDO STEEL CO., LTD., Nagoya-shi (JP); SAKAMURA HOT ART CO., LTD., Kuse-gun (JP)

(72) Inventors: Hideaki Hayashi, Tokai (JP); Daisuke Enomoto, Kyoto (JP); Masahiro Taniguchi, Kyoto (JP); Minoru Enomoto, Kyoto (JP)

(73) Assignees: DAIDO STEEL CO., LTD., Nagoya-Shi, Aichi (JP); SAKAMURA HOT ART CO., LTD., Kuse-Gun, Kyoto (JP)

( * ) Notice: Subject to any disclaimer, the term of this patent is extended or adjusted under 35 U.S.C. 154(b) by 24 days.

(21) Appl. No.: 15/602,229

(22) Filed: May 23, 2017

(65) Prior Publication Data

US 2017/0341125 A1 Nov. 30, 2017

(30) Foreign Application Priority Data

May 26, 2016 (JP) ..... 2016-105673

(51) Int. Cl.

| | |
|---|---|
| ***B21D 37/10*** | (2006.01) |
| ***B21D 37/04*** | (2006.01) |
| ***B21J 13/03*** | (2006.01) |
| ***B21D 22/02*** | (2006.01) |
| ***B21J 9/02*** | (2006.01) |
| ***B21J 13/08*** | (2006.01) |

(52) U.S. Cl.

CPC ..... *B21D 37/10* (2013.01); *B21D 22/02* (2013.01); *B21D 37/04* (2013.01); *B21J 9/022* (2013.01); *B21J 13/03* (2013.01); *B21J 13/085* (2013.01)

(58) Field of Classification Search

CPC ..... B21D 37/04; B21D 37/02; B21D 37/10; B21D 37/14; B21D 22/02; B21D 37/12; B21J 13/03; B21J 13/085; B21J 9/022

See application file for complete search history.

(56) References Cited

U.S. PATENT DOCUMENTS 4,648,727 A * 3/1987 O'Neil ..... B21D 37/12 384/49
2006/0223687 A1 10/2006 Hedin
2013/0276500 A1* 10/2013 Tsuda ..... B21D 39/023 72/252.5

(Continued)

FOREIGN PATENT DOCUMENTS

CN 202316693 U 7/2012
CN 202540798 U 11/2012
CN 103658325 A * 3/2014

(Continued)

OTHER PUBLICATIONS

EPO translation of CN 103658325 A, Sep. 2018.*

(Continued)

*Primary Examiner* — Pradeep C Battula
(74) *Attorney, Agent, or Firm* — McGinn IP Law Group, PLLC

(57) ABSTRACT

The present invention provides a mold fixing structure capable of easily performing work in which a mold carried into a machine is fixed to a mold mounting surface of the machine, and work in which the mold fixed to the mold mounting surface is carried out to the outside of the machine.

20 Claims, 6 Drawing Sheets

(56) References Cited

U.S. PATENT DOCUMENTS

2015/0165506 A1* 6/2015 Jansen ..... B21D 37/14
72/429

FOREIGN PATENT DOCUMENTS

| | | | |
|---|---|---|---|
| CN | 204338726 | U | 5/2015 |
| JP | 60-030534 | A | 2/1985 |
| JP | H 10-044157 | A | 2/1998 |
| JP | 2011-212733 | S | 10/2011 |

OTHER PUBLICATIONS

Chinese Office Action dated Sep. 4, 2018, in Chinese Patent Application No. 201710384455.1, with an English translation.
Chinese Office Action dated Jun. 4, 2019, in Chinese Patent Application No. 201710384455.1, with an English translation.

* cited by examiner

MOLD FIXING STRUCTURE

FIELD OF THE INVENTION

The present invention relates to a mold fixing structure, and particularly relates to a mold fixing structure capable of easily replacing a mold.

BACKGROUND OF THE INVENTION

For example, in a multistage forging press machine in which a plurality of forging portions provided with dies and punches are provided in parallel in a horizontal direction, a fixed mold provided with the dies is fixedly attached to a frame side, and a movable mold provided with the punches is fixedly attached to a ram side.

Those molds are replaced suitably to produce a product having a different shape. The molds may be heavy goods as heavy as several tons in some cases. Work of replacing the molds is not easy. It has been therefore desired to improve workability in the work.

In a typical multistage forging press machine, the top of a frame is open. Therefore, a crane or a dedicated mold hanging device is used for the work of mold replacement through the open space.

However, when a crane is used for replacing a mold, the work time becomes long. Thus, the operating rate of equipment deteriorates to impair productivity.

On the other hand, when a dedicated mold hanging device is installed for replacing a mold, the structure of the mold hanging device is always placed on/above the press machine. During maintenance work of the machine, there arises a problem that workability deteriorates due to interference with the structure of the mold hanging device, or the like.

The following Patent Document 1 discloses an invention about a "mold replacement apparatus". In the mold replacement apparatus, a plurality of conveyance rollers are disposed in a horizontal direction on a mold mounting surface to which a mold is fixedly attached. In order to replace the mold, the mold is moved in the horizontal direction by use of the conveyance rollers so that the mold can be carried out or in.

The following Patent Document 2 discloses an invention about a "multistage horizontal forging apparatus". In the multistage horizontal forging apparatus, a movable mold and a fixed mold are attached to a ram and a frame respectively, through split blocks. In addition, rail grooves extending horizontally are provided in the split blocks respectively so that the movable mold and the fixed mold can be extracted horizontally together with the split blocks by guidance of the rail grooves in order to replace the molds.

According to Patent Document 1 and Patent Document 2, a mold is extracted horizontally by use of the conveyance rollers or the like in order to replace the mold. Thus, it is not necessary to replace the mold using a crane or the like as in the background art, but it is possible to replace the mold comparatively easily.

However, an engagement part for positioning or the like is generally located between a mold and a mold mounting surface to which the mold is fixed. Therefore, in order to carry out and horizontally move the mold toward the outside of the apparatus as in those Patent Documents, not only it is necessary to cancel a fixing force with which the mold is fixed to the mold mounting surface, but it is also necessary to separate the heavy mold from the mold mounting surface until the engagement between the mold and the mold mounting surface is completely cancelled.

According to Patent Documents 1 and 2, a conveyance unit such as the conveyance rollers for horizontally carrying out and move the mold is simply added and fixed. In those Patent Documents, there is no suggestion about any specific configuration for performing a series of operations, that is, cancelling the fixing force and then separating the mold from the mold mounting surface so that the mold can be carried out and moved.

Patent Document 1: JP-A-10-44157

Patent Document 2: JP-A-2011-212733

SUMMARY OF THE INVENTION

The aforementioned situation is attributed to the present invention. An object of the present invention is to provide a mold fixing structure capable of easily performing work in which a mold carried into a machine is fixed to a mold mounting surface of the machine, and work in which the mold fixed to the mold mounting surface is carried out to the outside of the machine.

Namely, the present invention relates to the following configurations (1) to (4).

(1) A mold fixing structure for fixing a mold having a punch or a die to a mold mounting surface of a press machine, in which a plurality of mold supporting bodies are disposed in the mold mounting surface, each of the mold supporting bodies including (a) a shaft portion that is disposed to protrude perpendicularly from the mold mounting surface so as to be movable forward and backward, (b) a flange portion that is provided on a front end side of the shaft portion so as to extend in a direction perpendicular to an axis of the shaft portion, and (c) a bearing portion that is provided further on the front end side of the shaft portion from the flange portion, the bearing portion being larger in outer diameter than the flange portion; and the mold is supported by the bearing portion of each of the mold supporting bodies in a layout in which a part of the mold is located above the bearing portion and at a lateral side of the flange portion on a side of the mold mounting surface, so that the mold is fixed to the mold mounting surface and released from being fixed thereto in accordance with forward and backward movement of the shaft portion.

(2) The mold fixing structure according to (1), in which a groove portion having a T-shape in section and extending linearly is formed in a surface of the mold opposed to the mold mounting surface, so that the mold is supported in a state where a front end portion of one of the mold supporting bodies, including the flange portion and the bearing portion thereof, is fitted into the groove portion.

(3) The mold fixing structure according to (2), in which a plurality of the groove portions are formed in parallel in the mold so that the mold is supported in a state where a plurality of front end portions of the mold supporting bodies are fitted into the groove portions respectively.

(4) The mold fixing structure according to any one of (1) to (3), in which a positioning convex portion or a positioning concave portion is provided in a surface of the mold opposed to the mold mounting surface, and a positioning concave portion or a positioning convex portion is provided in the mold mounting surface, so that the convex portion and the concave portion are fitted to each other, thereby positioning the mold when the mold approaches the mold mounting surface.

As described above, according to the present invention, each of the mold supporting bodies disposed in the mold mounting surface includes the shaft portion that is movable forward and backward, the flange portion that is provided on a front end side of the shaft portion, and the bearing portion that is provided further on the front end side of the shaft portion from the flange portion and that is larger in outer diameter than the flange portion. The mold is supported by the bearing portion of each of the mold supporting bodies in the layout in which a part of the mold is located above the bearing portion and at a lateral side of the flange portion on a side of the mold mounting surface, so that the mold can be fixed to the mold mounting surface and released from being fixed thereto in accordance with forward and backward movement of the shaft portion.

According to the present invention, in order to fix a new mold to the mold mounting surface, the shaft portions of the mold supporting bodies are moved in a direction in which the front end portions of the mold supporting bodies approach the mold mounting surface. Thus, the mold carried in from the outside of the machine can be made close to the mold mounting surface while being supported by the bearing portions.

That is, since the mold moves in the direction approaching the mold mounting surface together with the bearing portions, an excessive frictional force does not occur between the mold and each bearing portion, but the mold can be moved and positioned in the direction approaching the mold mounting surface easily.

In addition, after the mold abuts against the mold mounting surface, a part of the mold is held between each flange portion and the mold mounting surface. Thus, the mold can be positioned and fixed.

In this manner, according to the present invention, a series of operations in which the mold carried in from the outside of the machine is made close to the mold mounting surface until the mold is positioned and fixed can be performed continuously by movement of the shaft portions.

On the other hand, in order to remove the mold that has been fixed, the shaft portions are moved in a direction in which the front end portions of the mold supporting bodies leave the mold mounting surface. Thus, the fixing force of the mold that has been fixed is cancelled. Successively, the mold can be separated from the mold mounting surface to a position cancelling the engagement between the mold and the mold mounting surface.

On this occasion, the mold moves in the leaving direction together with the bearing portions. Thus, an excessive frictional force does not occur between the mold and each bearing portion, but the mold can be moved in the leaving direction to a predetermined position easily.

After the mold has been moved and positioned in the leaving direction together with the bearing portions, the mold can be moved in the rotating direction of the bearing portions, that is, in the carrying-out direction to the outside of the machine without generating interference between the mold and the mold mounting surface.

In this manner, a series of operations for cancelling the fixing force of the mold that has been positioned and fixed, and separating the mold from the mold mounting surface so that the mold can be carried out to the outside of the machine can be performed continuously by movement of the shaft portions.

According to the present invention, an end surface of the mold can be supported by the bearing portions of the mold supporting bodies. However, according to the aforementioned configuration (2), a groove portion having a T-shape in section and extending linearly may be formed in a surface of the mold opposed to the mold mounting surface, so that the mold can be supported in a state where a front end portion of one of the mold supporting bodies is fitted into the groove portion.

According to this configuration, the inner wall surfaces of the groove portion are located in the up/down directions and the left/right directions of the front end portion of the mold supporting body (i.e., directions perpendicular to the carrying-in/carrying-out direction of the mold). Thus, looseness of the mold in the directions perpendicular to the carrying-in/carrying-out direction of the mold can be restricted excellently when the mold is carried in and carried out. It is therefore possible to move the mold smoothly in an intended direction.

In addition, the front end portion of the mold supporting body is received inside the mold, specifically in the groove portion in the state where the mold has been fixed, and the front end portion of the mold supporting body is not left in a protruding state around the mold. Thus, there is no concern that there arises a problem that workability may deteriorate, for example, due to interference or the like with the front end portion of the mold supporting body during works other than the mold replacement, such as maintenance work of the machine.

In the aforementioned configuration (2), it is desired that a plurality of the groove portions are formed in parallel, and the front end portions of a plurality of the mold supporting bodies are fitted into the groove portions respectively to thereby support the mold (the aforementioned configuration (3)).

In this manner, the mold can be excellently prevented from tilting when the mold is made to approach or leave the mold mounting surface.

In addition, according to the present invention, a positioning convex portion or a positioning concave portion may be provided in a surface of the mold opposed to the mold mounting surface, and a positioning concave portion or a positioning convex portion may be provided in the mold mounting surface, so that the convex portion and the concave portion can be fitted to each other, thereby positioning the mold when the mold approaches the mold mounting surface (the aforementioned configuration (4)).

In this manner, when the mold is made to approach the mold mounting surface for fixing thereto, the mold can be automatically positioned by fitting between the convex portion and the concave portion provided in the mold and the mold mounting surface respectively.

According to the present invention described above, it is possible to provide a mold fixing structure capable of easily performing work in which a mold carried into a machine is fixed to a mold mounting surface of the machine, and work in which the mold fixed to the mold mounting surface is carried out to the outside of the machine.

DETAILED DESCRIPTION OF THE INVENTION

Next, an embodiment of the present invention will be described in detail with reference to the drawings.

Figure 1:
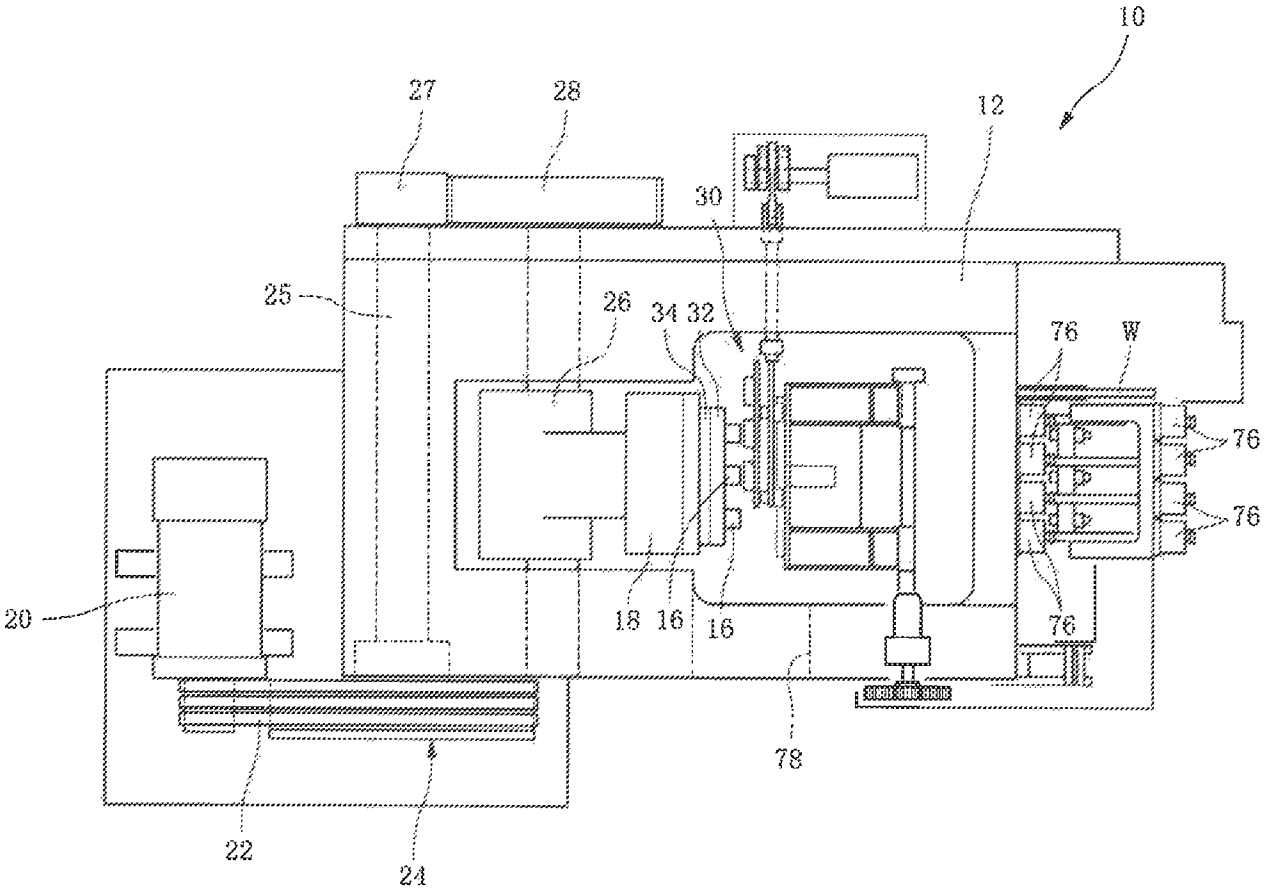
FIG. 1 is a plan view of a multistage forging press machine having a mold fixing structure according to an embodiment of the present invention.

FIG. 1 is a view showing a multistage forging press machine having a mold fixing structure according to the present embodiment.

In FIG. 1, in a multistage forging press machine 10 (hereinafter also referred to as forging press machine), a plurality (three stages here) of forging portions for forging workpieces are provided in parallel at predetermined intervals in a horizontal direction inside a frame 12 having a box-like shape.

Each forging portion includes a die 14 (FIG. 2) fixed to the frame 12 side, and a punch 16 disposed to be opposed to the die 14.

Each punch 16 is attached to the front end side of a ram 18. By forward movement of the ram 18, materials (workpieces) are formed concurrently in the forging portions respectively.

In the forging press machine 10 according to the present embodiment, a main motor 20 is provided as a power source for the ram 18. The main motor 20 is connected to a fly wheel 24 through a belt 22. The fly wheel 24 is connected to the ram 18 through a crank shaft 26.

In detail, a pinion gear 27 provided at an end portion of a fly wheel shaft 25 on the opposite side to the fly wheel 24 and a large gear 28 provided at an end portion of the crank shaft 26 are connected to be engaged with each other.

Thus, in the present embodiment, as the fly wheel 24 is rotated by the power of the main motor 20, the ram 18 moves forward and backward due to the power of the fly wheel 24. That is, the punches 16 attached to the front end side of the ram 18 move forward and backward relatively to the dies 14 to thereby perform forging.

In the forging press machine 10 thus configured, a material (workpiece W) supplied from the outside passes through the aforementioned three stages of forging portions sequentially to be thereby formed into a predetermined shape. On this occasion, the workpiece W is conveyed to each forging portion by a transfer device 30.

A product that has been completely forged is conveyed to the outside of the machine by a not-shown conveyance device.

Figure 2:
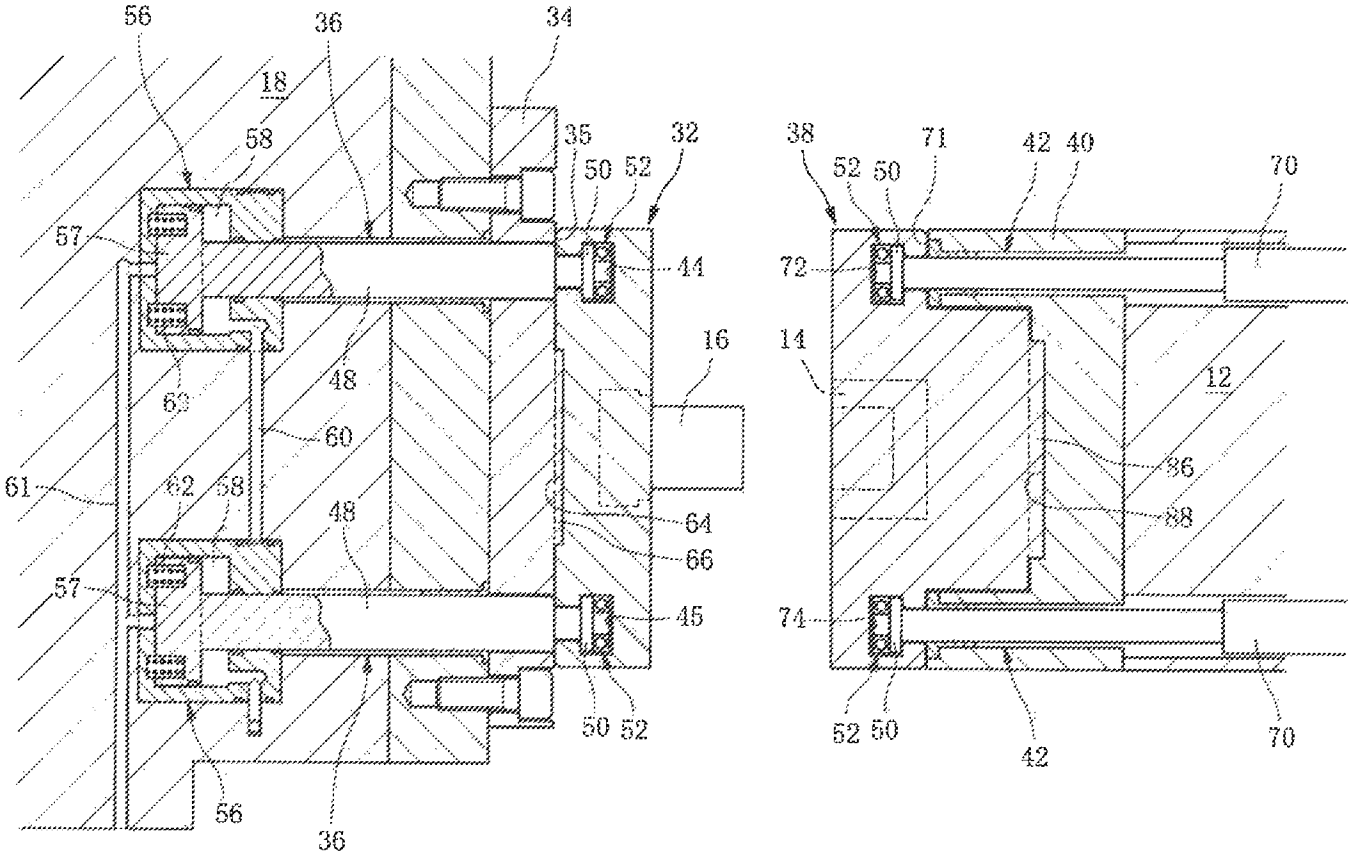
FIG. 2 is an enlarged sectional view showing a forging portion of the multistage forging press machine of FIG. 1.

FIG. 2 is an enlarged view showing a forging portion. In the left side of FIG. 2, the reference numeral 32 represents a movable mold including three punches 16 provided in parallel in a horizontal direction (a direction perpendicular to the paper of FIG. 2), and the reference numeral 34 represents a movable-side mold mounting member attached to the ram 18 side. The movable mold 32 is removably attached and fixed to the mold mounting member 34 through mold supporting bodies 36.

On the other hand, on the right side of FIG. 2, the reference numeral 38 represents a fixed mold including three dies 14 provided in parallel in the horizontal direction, and the reference numeral 40 represents a fixed-side mold mounting member attached to the frame 12 side. The fixed mold 38 is removably attached and fixed to the mold mounting member 40 through mold supporting bodies 42.

A mold fixing structure in the movable mold 32 will be described below in detail.

Figure 3:
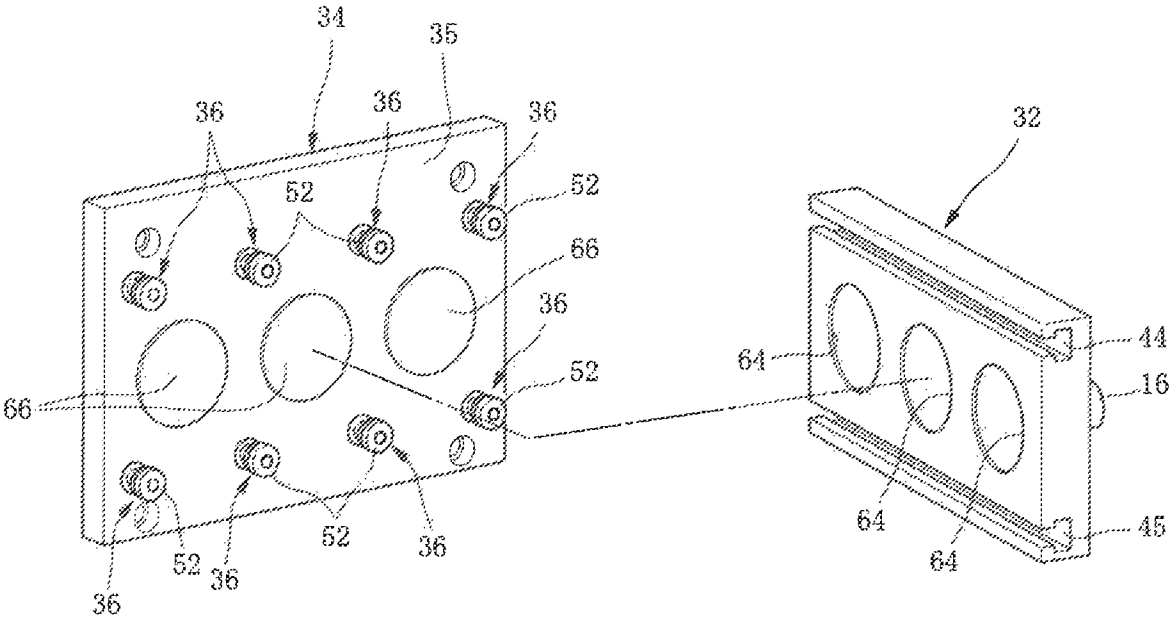
FIG. 3 is a perspective view showing a mold mounting member and a movable mold in FIG. 2, the mold mounting member and the movable mold being separated from each other.

FIG. 3 is a view showing the movable-side mold mounting member 34 and the movable mold 32, which are separated from each other. As shown in FIG. 3, groove portions 44 and 45 each having a T-shape in section are provided in an upper portion and a lower portion of a back surface (a surface opposed to a mold mounting surface 35 of the mold mounting member 34) of the movable mold 32 respectively so as to extend linearly in the horizontal direction.

Between the groove portions 44 and 45, positioning concave portions 64 are provided at three places in parallel in the horizontal direction. In the present embodiment, central positions of the positioning concave portions 64 are aligned with central positions of the punches 16 in a front surface of the movable mold 32.

On the other hand, the mold mounting member 34 has a substantially flat plate-like shape, in which mold supporting bodies 36 are provided at four places in the horizontal direction in an upper portion and a lower portion of the mold mounting surface 35 to which the movable mold 32 is attached. In the present embodiment, front end portions of the mold supporting bodies 36 are fitted into the grooves 44 and 45 of the movable mold 32 respectively to thereby support the movable mold 32.

As will be described later, a bearing portion 52 is provided in a front end portion of each mold supporting body 36 so that the bearing portion 52 can rotate around the axis of the mold supporting body 36. When the movable mold 32 is carried out, the movable mold 32 can slidably move in the horizontal direction in a state where the movable mold 32 is supported by the mold supporting bodies 36.

In addition, among the mold supporting bodies 36 provided in the upper portion and the lower portion of the mold mounting surface 35, convex portions 66 are formed in positions corresponding to the concave portions 64 in the movable mold 32. When the movable mold 32 is fixed to the mold mounting surface 35, the concave portions 64 and the convex portions 66 are fitted to each other in a concave-convex fitting manner, thereby positioning the movable mold 32 relatively to the mold mounting surface 35.

Figure 4:
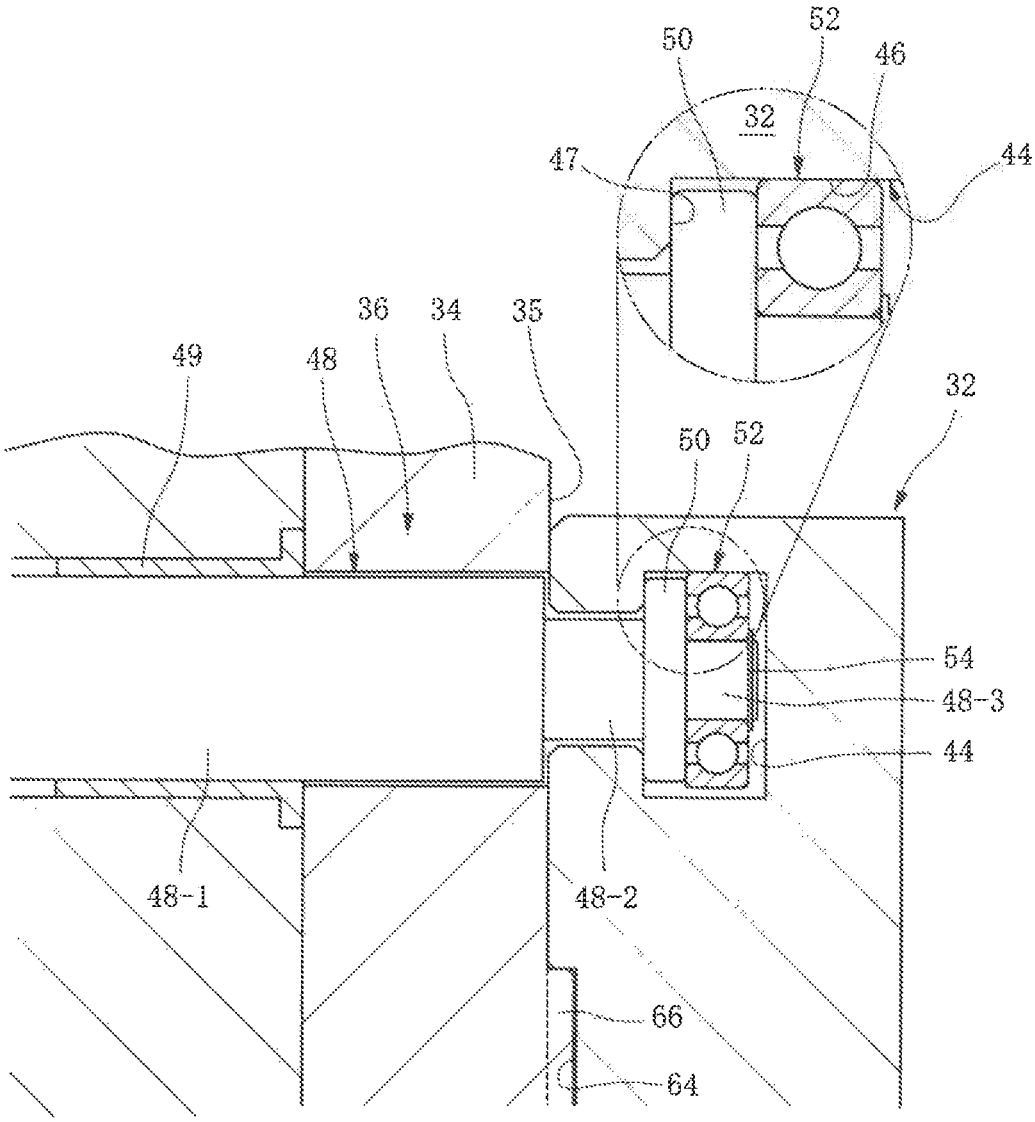
FIG. 4 is an enlarged view showing a mounting/fixing part of the movable mold in FIG. 2.

FIG. 4 is an enlarged view showing a mounting/fixing part of the movable mold 32.

A shaft portion 48 is disposed to protrude perpendicularly from the mold mounting surface 35 extending in the up/down direction of the mold mounting member 34. The shaft portion 48 has a stepped shape including a large diameter portion 48-1, a middle diameter portion 48-2 and a small diameter portion 48-3, whose outer diameters are reduced sequentially toward the front end of the shaft portion 48. The shaft portion 48 is guided by a sleeve 49 fitted to an outer circumferential surface of the large diameter portion 48-1 so that the shaft portion 48 can move forward and backward in the horizontal direction.

In a boundary portion between the middle diameter portion 48-2 and the small diameter portion 48-3, a flange portion 50 having an annular shape is formed to project in a direction perpendicular to the axis of the shaft portion 48. A bearing portion 52 having an outer ring that can rotate around the axis of the shaft portion 48 is attached to the outer circumference of the small diameter portion 48-3 located on the front end side of the flange portion 50.

Here, the outer diameter (for more details, the outer diameter of the outer ring) of the bearing portion 52 is set to be larger than the outer diameter of the flange portion 50.

In the present embodiment, each mold supporting body 36 supporting the movable mold 32 is constituted by the shaft portion 48, the flange portion 50 and the bearing portion 52.

Incidentally, on the further front end side of the small diameter portion 48-3 from the bearing portion 52, a stopper ring 54 is attached for preventing the bearing portion 52 from coming off.

In the present embodiment, as shown in FIG. 4, the front end portion of the mold supporting body 36 including the flange portion 50 and the bearing portion 52 is fitted into the groove portion 44 formed in the movable mold 32 to thereby support the movable mold 32. For more details, the outer diameter of the bearing portion 52 is set to be larger than the outer diameter of the flange portion 50 so that an upper portion of the outer circumferential surface of the bearing portion 52 can abut against an upper wall surface 46 of the groove portion 44 to thereby support the movable mold 32 as shown in the partially enlarged view in FIG. 4.

On the other hand, a clearance is formed in the up/down direction between the flange portion 50 smaller in outer diameter than the bearing portion 52, and the upper wall surface 46 of the groove portion 44.

FIG. 4 shows a state in which the movable mold 32 has been positioned and fixed on the mold mounting surface 35. In the present embodiment, as shown in FIG. 4, a left wall surface 47 of the groove portion 44 is located at a lateral part of the flange portion 50 on the mold mounting surface 35 side so that a part of the movable mold 32, specifically a part located between the flange portion 50 and the mold mounting surface 35 and including the left wall surface 47 of the groove portion 44, can be held between the flange portion 50 and the mold mounting surface 35 to thereby fixedly position the movable mold 32.

In addition, as shown in FIG. 2, an oil hydraulic cylinder 56 is provided inside the ram 18, and a piston 57 sliding inside the oil hydraulic cylinder 56 is integrally attached to the base end side of the shaft portion 48 of the mold supporting body 36.

The reference numeral 58 represents an oil chamber in the oil hydraulic cylinder 56. The oil chamber 58 is sectioned by a vessel of the oil hydraulic cylinder 56 and the piston 57. Oil from a not-shown oil hydraulic pump is supplied to the oil chamber 58 through an oil channel 60.

In addition, a spring 62 is provided in a space of the piston 57 on the opposite side to the oil chamber 58.

Incidentally, the reference numeral 61 represents a communication path through which a space receiving the spring 62 can communicate with the atmosphere.

In the present embodiment, in order to make the movable mold 32 close to the mold mounting surface 35 and further press the movable mold 32 onto the mold mounting surface 35 to thereby position and fix the movable mold 32 thereon, pressure inside the oil chamber 58 is increased to move the shaft portion 48 to the illustrated left.

On the contrary, in order to move the movable mold 32 in a direction leaving the mold mounting surface 35, the oil pressure inside the oil chamber 58 is reduced so that the shaft portion 48 can be moved to the illustrated right due to an urging force of the spring 62 in the illustrated rightward direction.

Next, mold replacement in the forging press machine 10 according to the present embodiment will be described along the movable mold 32 by way of example.

For example, as shown in FIG. 4, when the movable mold 32 fixed to the mold mounting surface 35 is intended to be conveyed to the outside of the machine, the shaft portion 48 of each of the mold supporting bodies 36 supporting the movable mold 32 is moved to the illustrated right. In this manner, first, the fixing force with which the movable mold 32 has been pressed onto the mold mounting surface 35 is cancelled.

Figure 5A:
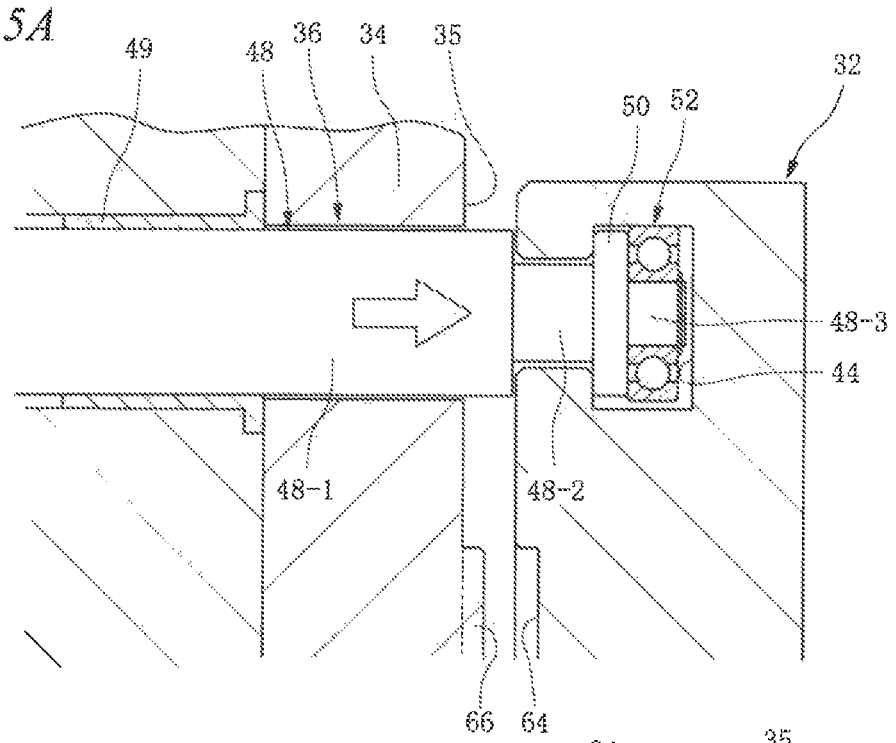
FIGS. 5A and 5B are views for explaining mold replacement according to the embodiment.

Successively, the movable mold 32 moves in a direction leaving the mold mounting surface 35 together with the front end portions of the mold supporting bodies 36 to thereby cancel the engagement between the concave portions 64 on the mold side and the convex portions 66 on the mold mounting surface 35 side. FIG. 5A shows such a state.

On this occasion, the movable mold 32 moves in the leaving direction together with the bearing portions 52. Therefore, an excessive frictional force does not occur between the movable mold 32 and each of the bearing portions 52 supporting the weight of the movable mold 32, but the movable mold 32 can be moved to a predetermined position in the leaving direction.

Figure 5B:
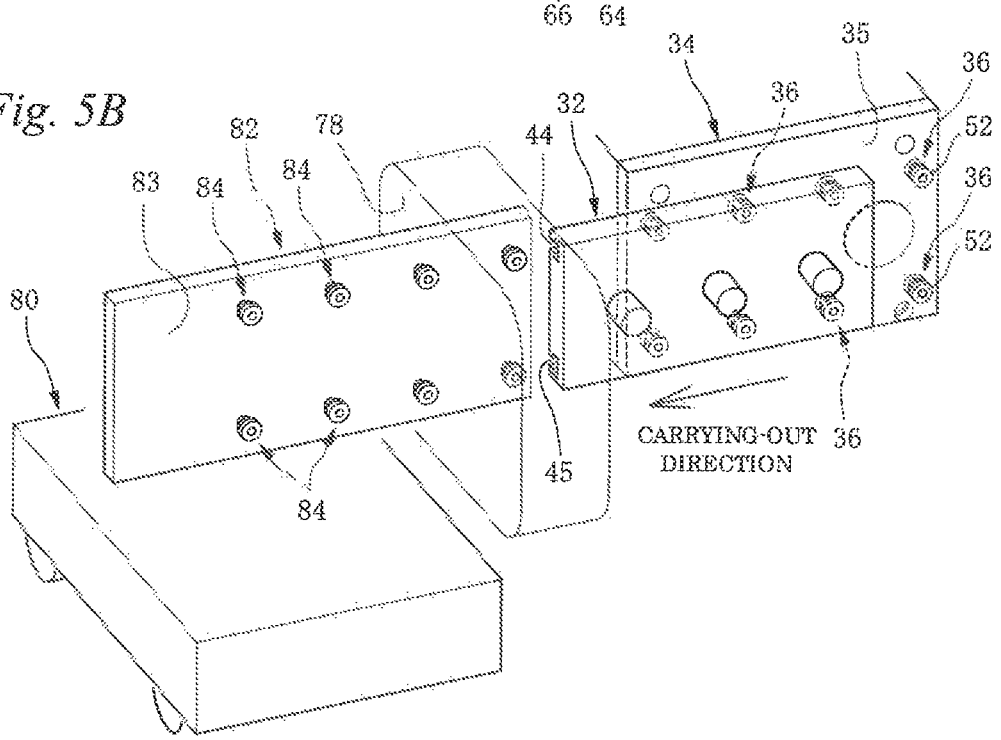

After the movable mold 32 is completely moved in the leaving direction, the movable mold 32 can move in a direction in which the mold supporting bodies 36 are provided in parallel, that is, in a direction in which the movable mold 32 can be conveyed to the outside of the machine, while the movable mold 32 remains supported by the mold supporting bodies 36 (specifically the bearing portions 52), as shown in FIG. 5B.

In FIG. 5B, the reference numeral 78 represents a through-opening portion, which is formed in a side surface of the frame 12 in the mold carrying-out direction, and the reference numeral 80 represents a cart for mold replacement, which is disposed outside the through-opening portion 78.

A retention plate 82 for retaining the carried-out movable mold 32 is provided on an upper surface of the cart 80. In a mold retention surface 83 of the retention plate 82, a plurality of shaft bodies 84 having bearings in their front end portions are disposed horizontally to be as high as the mold supporting bodies 36.

As shown in FIG. 5B, the retention plate 82 can move in a direction entering the through-opening portion 78. The front end portions of the shaft bodies 84 are sequentially fitted into the groove portions 44 and 45 of the movable mold 32 that has moved in the carrying-out direction. Thus, the movable mold 32 is supported. After that, the retention plate 82 moves onto the cart 80 outside the machine together with the movable mold 32. In this manner, the movable mold 32 is completely carried out to the outside of the machine.

Figure 6A:
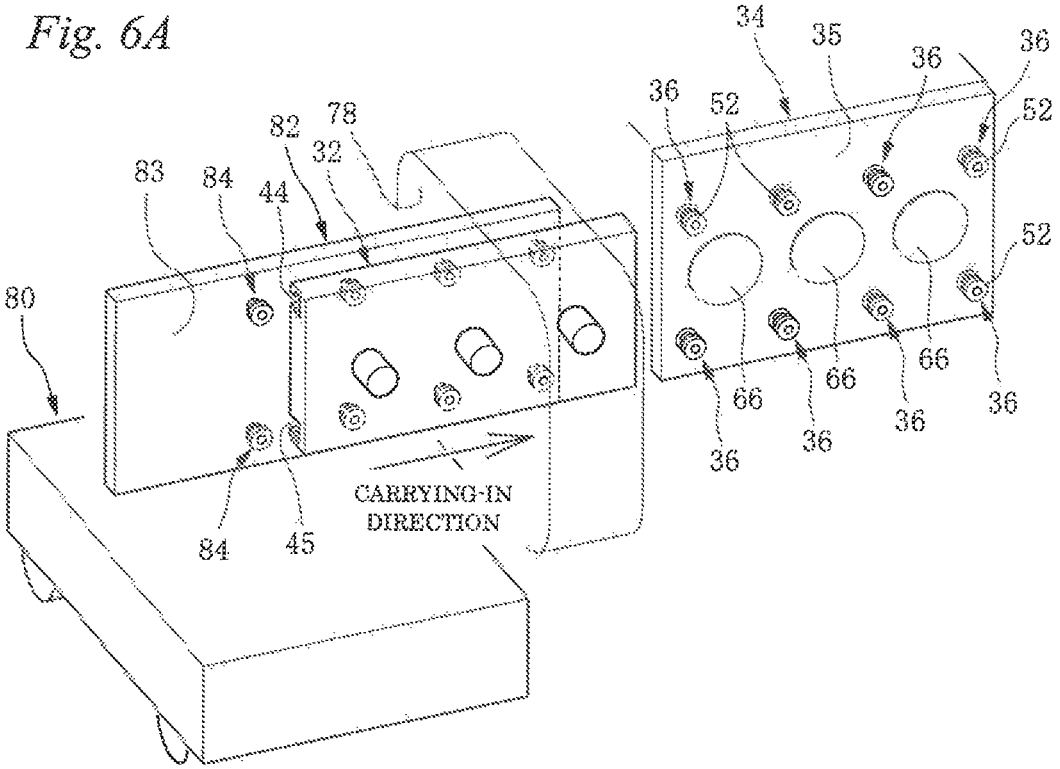
FIGS. 6A and 6B are views for explaining mold replacement different from FIGS. 5A and 5B.

On the other hand, when a new movable mold 32 is intended to be attached and fixed to the mold mounting surface 35, the cart 80 holding the new movable mold 32 is moved to the position of the through-opening portion 78. After that, as shown in FIG. 6A, the movable mold 32 is moved into the through-opening portion 78 together with the retention plate 82.

After that, the movable mold 32 is moved to fit the front end portions of the mold supporting bodies 36 into the groove portions 44 and 45 of the movable mold 32 sequentially. Thus, the movable mold 32 is moved to a predetermined position.

Figure 6B:
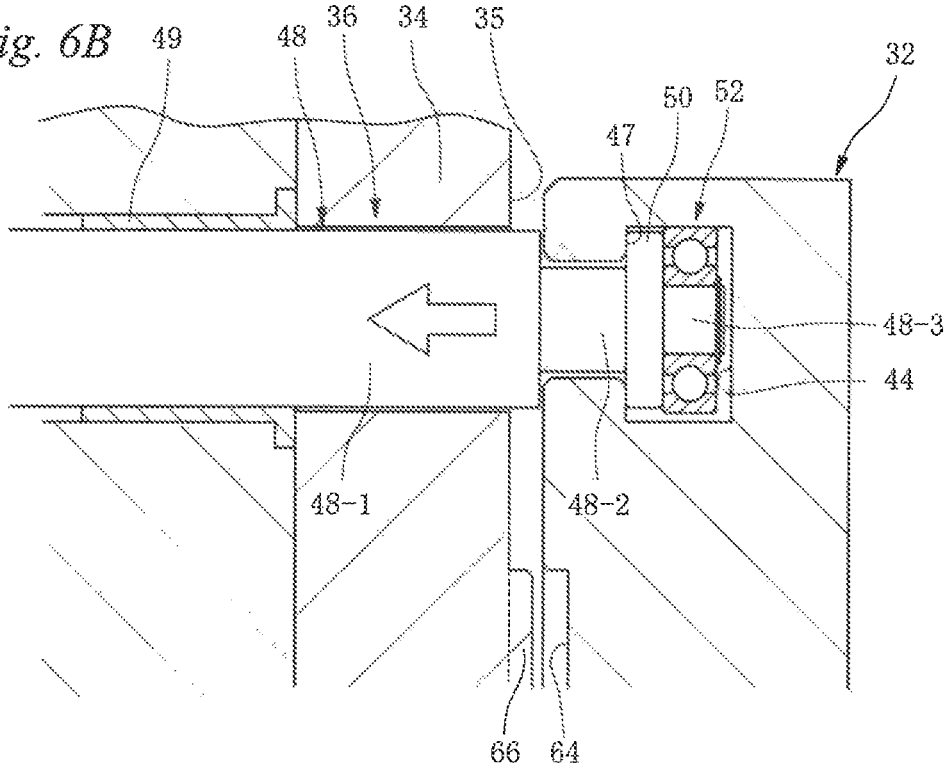

After that, as shown in FIG. 6B, the shaft portion 48 of each of the mold supporting bodies 36 is moved in a direction (the illustrated leftward direction) in which the front end portion of the mold supporting body 36 approaches the mold mounting surface 35. In this manner, the movable mold 32 supported by the bearing portions 52 of the mold supporting bodies 36 approaches the mold mounting surface 35, and the concave portions 64 on the mold side are fitted to the convex portions 66 on the mold mounting surface 35 side. Thus, the movable mold 32 can be automatically positioned.

Then, the movable mold 32 further approaches the mold mounting surface 35. After the movable mold 32 abuts against the mold mounting surface 35, the movable mold 32 is held between each flange portion 50 and the mold mounting surface 35 so that the movable mold 32 can be fixedly positioned on the mold mounting surface 35. In this manner, the movable mold 32 can be completely mounted and fixed.

Incidentally, the motion of one of the mold supporting bodies 36 has been described above. However, all the shaft portions 48 of the mold supporting bodies 36 are moved forward and backward concurrently during the mold replacement.

According to the present embodiment, as described above, in order to fix the new movable mold 32 to the mold mounting surface 35, the shaft portions 48 are moved in a direction in which the front end portions of the mold supporting bodies 36 approach the mold mounting surface 35. Thus, the movable mold 32 carried in from the outside of the machine can be made close to the mold mounting surface 35 while remaining supported by the bearing portions 52.

That is, since the movable mold 32 moves in the approaching direction together with the bearing portions 52, an excessive frictional force does not occur between the movable mold 32 and each bearing portion 52, but the movable mold 32 can be moved and positioned in the approaching direction easily.

In addition, after the movable mold 32 abuts against the mold mounting surface 35, the movable mold 32 is held between each flange portion 50 and the mold mounting surface 35. Thus, the movable mold 32 can be positioned and fixed.

In this manner, according to the present embodiment, a series of operations for making the carried-in movable mold 32 close to the mold mounting surface 35 until the movable mold 32 is positioned and fixed can be performed continuously by movement of the shaft portions 48.

On the other hand, in order to remove the mold, the shaft portions 48 are moved in a direction in which the front end portions of the mold supporting bodies 36 leave the mold mounting surface 35. On the way of this process, the fixing force to the movable mold 32 that has been fixed is cancelled. Successively, the movable mold 32 can be moved to a position cancelling the engagement between the movable mold 32 and the mold mounting surface 35, specifically the engagement between the positioning concave portions 64 of the movable mold 32 and the positioning convex portions 66 of the mold mounting surface 35.

On this occasion, the movable mold 32 moves in the leaving direction together with the bearing portions 52. Thus, an excessive frictional force does not occur between the movable mold 32 and each bearing portion 52, but the movable mold 32 can be moved in the leaving direction to a predetermined position easily.

After the movable mold 32 has been moved and positioned in the leaving direction together with the bearing portions 52, the movable mold 32 can be moved in the rotating direction of the bearing portions 52, that is, in the carrying-out direction to the outside of the machine without generating interference between the movable mold 32 and the mold mounting surface 35.

In this manner, according to the present embodiment, a series of operations for cancelling the fixing force to the movable mold 32 that has been positioned and fixed, and separating the movable mold 32 from the mold mounting surface 35 so that the movable mold 32 can be carried out to the outside of the machine can be performed continuously by movement of the shaft portions 48.

In the present embodiment, the groove portions 44 and 45 each having a T-shape in section and extending linearly are formed in the surface of the movable mold 32 opposed to the mold mounting surface 35, and the front end portions of the mold supporting bodies 36 are fitted into the groove portions 44 and 45 to thereby support the movable mold 32. Therefore, the inner wall surfaces of the groove portions 44 and 45 are located in the up/down directions and the left/right directions of the front end portions of the mold supporting bodies 36. Thus, looseness of the movable mold 32 in a direction perpendicular to the carrying-in/carrying-out direction of the movable mold 32 can be restricted excellently when the movable mold 32 is carried in and carried out. It is therefore possible to move the movable mold 32 smoothly.

In addition, the front end portions of the mold supporting bodies 36 are received inside the mold, specifically in the groove portions 44 and 45 in the state where the movable mold 32 has been fixed. There is no concern that the front end portions of the mold supporting bodies 36 are left in a protruding state around the movable mold 32. Thus, there is no concern that there arises a problem that workability may deteriorate, for example, due to interference or the like with the front end portions of the mold supporting bodies 36 during works other than the mold replacement, such as maintenance work of the press machine.

In the present embodiment, the plurality of groove portions 44 and 45 are formed, and the front end portions of the plurality of mold supporting bodies 36 are fitted into the groove portions respectively to thereby support the movable mold 32. Therefore, the movable mold 32 can be excellently prevented from tilting when the movable mold 32 is made to approach or leave the mold mounting surface 35.

In addition, in the present embodiment, the positioning concave portions 64 are provided in the surface of the movable mold 32 opposed to the mold mounting surface 35, and the positioning convex portions 66 are provided in the mold mounting surface 35. Thus, the movable mold 32 can be automatically positioned by fitting between the convex portions 66 and the concave portions 64 when the movable mold 32 is made close to the mold mounting surface 35 in order to fix the movable mold 32 at the time of mold replacement.

The mold fixing structure and the mold replacement method have been described above in detail about the movable mold 32. The same things can be fundamentally applied to a mold fixing structure and a mold replacement method about the fixed mold 38.

In FIG. 2, each shaft portion 70 is disposed to protrude perpendicularly from a mold mounting surface 71 extending in the up/down direction of a mold mounting member 40 on the fixed side. On the front end side of the shaft portion 70, a flange portion 50 having an annular shape is formed to protrude in a direction perpendicular to the axis of the shaft portion 70. A bearing portion 52 having an outer ring that can rotate around the axis of the shaft portion 70 is provided further on the front end side of the flange portion 50. Here, the outer diameter of the bearing portion 52 is set to be larger than the outer diameter of the flange portion 50.

In the present embodiment, each mold supporting body 42 supporting the fixed mold 38 is constituted by the shaft portion 70, the flange portion 50 and the bearing portion 52.

On the back surface side of the fixed mold 38, groove portions 72 and 74 each having a T-shape in section are formed in an upper portion and a lower portion of the movable mold 38 respectively in the similar manner as in the case of the movable mold 32. The front end portions of the mold supporting bodies 42 including the flange portions 50 and the bearing portions 52 are fitted into the groove portions 72 and 74 formed in the fixed mold 38, whereby the fixed mold 38 is supported. For more details, the bearing portion 52 of each mold supporting body 42 is set to be larger in outer diameter than the flange portion 50. Thus, the outer surfaces of the bearing portions 52 abut against the upper wall surfaces of the groove portions 72 and 74 to thereby support the fixed mold 38.

In addition, though not shown in FIG. 2, a piston sliding inside an oil hydraulic cylinder 76 (FIG. 1) is integrally attached to the base end side of each shaft portion 70. Oil pressure inside the oil hydraulic cylinder 76 is controlled to drive and move the shaft portion 70 forward and backward so that the fixed mold 38 can be moved in directions approaching and leaving the mold mounting surface 71.

Therefore, in order to fix a new fixed mold 38 to the mold mounting surface 71, the shaft portions 70 are moved in a direction in which the front end portions of the mold supporting bodies 42 approach the mold mounting surface 71. Thus, the fixed mold 38 carried in from the outside of the machine can be made close to the mold mounting surface 71 while remaining supported by the bearing portions 52.

In addition, after the fixed mold 38 abuts against the mold mounting surface 71, the fixed mold 38 is held between each flange portion 50 and the mold mounting surface 71. Thus, the fixed mold 38 can be positioned and fixed.

In this manner, also on the fixed mold 38 side, a series of operations for making the carried-in fixed mold 38 close to the mold mounting surface 71 until the fixed mold 38 is positioned and fixed can be performed continuously by movement of the shaft portions 70.

Incidentally, positioning convex portions 86 are formed in the surface of the fixed mold 38 opposed to the mold mounting surface 71, and positioning concave portions 88 are provided in the mold mounting surface 71. When the fixed mold 38 is made close to the mold mounting surface 71 so that the fixed mold 38 can be fixed for mold replacement, the fixed mold 38 is automatically positioned by engagement between the convex portions 86 and the concave portions 88

On the other hand, in order to remove the fixed mold 38, the shaft portions 70 are moved in a direction in which the front end portions of the mold supporting bodies 42 leave the mold mounting surface 71. On the way of this process, the fixing force to the fixed mold 38 that has been fixed is cancelled. Successively, the fixed mold 38 can be moved to a position cancelling the engagement between the fixed mold 38 and the mold mounting surface 71, specifically the engagement between the positioning convex portions 86 of the fixed mold 38 and the positioning concave portions 88 of the mold mounting surface 71.

After the fixed mold 38 has been moved and positioned in the leaving direction together with the bearing portions 52, the fixed mold 38 can be moved in the carrying-out direction to the outside of the machine without generating interference between the fixed mold 38 and the mold mounting surface 71.

In this manner, also on the fixed mold 38 side, a series of operations for cancelling the fixing force to the fixed mold 38 that has been positioned and fixed, and separating the fixed mold 38 from the mold mounting surface 71 so that the fixed mold 38 can be carried out to the outside of the machine can be performed continuously by movement of the shaft portions 70.

Although the embodiment of the present invention has been described above in detail, the embodiment is merely an example. For example, the number of mold supporting bodies disposed in a mold mounting surface may be different from that in the embodiment. In addition, the number of groove portions formed in the back surface of the mold may be set at one, or three or more in some cases.

The present invention may be performed in forms in which various changes have been made without departing from the gist of the invention. For example, the present invention may be applied to another press machine than the forging press machine.

The present application is based on Japanese patent application No. 2016-105673 filed on May 26, 2016, and the contents of which are incorporated herein by reference.

DESCRIPTION OF REFERENCE NUMERALS AND SIGNS

10 multistage forging press machine
14 die
16 punch
32 movable mold
35,71 mold mounting surface
36,42 mold supporting body
38 fixed mold
44,45,72,74 groove portion
48,70 shaft portion
50 flange portion
52 bearing portion
64,88 concave portion
66,86 convex portion

What is claimed is:

1. A method of fixing a mold to a mold mounting surface, the method comprising:

sliding the mold onto a mold supporting body comprising:
a shaft protruding from the mold mounting surface;
a flange formed on the shaft; and
a bearing formed on the shaft on a side of the flange that is opposite the mold mounting surface and supporting the mold, the mold being slid onto the mold supporting body so as to insert the flange and bearing into a groove in the mold; and reducing a distance by which the shaft protrudes from the mold mounting surface so that the flange forces a wall surface of the groove in a direction toward the mold mounting surface.

2. The method of claim 1, wherein in the reducing of the distance, a first positioning portion formed in the mold mounting surface is fitted with a second positioning portion formed in a surface of the mold opposite the mold mounting surface, to fix the mold to the mold mounting surface.

3. The method of claim 2, wherein the first positioning portion comprises one of a convex portion and a concave portion, and the second positioning portion comprises the other of the convex portion and the concave portion.

4. A mold fixing structure for a press machine, the mold fixing structure comprising:

a mold mounting surface;

a mold supporting body formed in the mold mounting surface and comprising:
a shaft protruding from the mold mounting surface;
a flange formed on the shaft; and a bearing formed on a side of the flange at an end of the shaft;

a mold which is fixable to the mold mounting surface by inserting the mold supporting body into the mold, and moving the shaft to reduce a distance by which the shaft protrudes from the mold mounting surface.

5. The mold fixing structure of claim 4, wherein the mold is releasable from the mold mounting surface by moving the shaft to increase a distance by which the shaft protrudes from the mold mounting surface.

6. The mold fixing structure of claim 4, wherein a part of the mold is located above the bearing and at a lateral side of the flange on a side of the mold mounting surface, and wherein the flange extends in a direction perpendicular to an axis of the shaft, and an outer diameter of the bearing is greater than an outer diameter of the flange.

7. The mold fixing structure of claim 4, further comprising:

a first positioning portion formed in the mold mounting surface; and a second positioning portion formed in a surface of the mold opposite the mold mounting surface, the second positioning portion engaging with the first positioning portion to fix the mold to the mold mounting surface and disengaging with the first positioning portion to release the mold from the mold mounting surface.

8. The mold fixing structure of claim 7, wherein the first positioning portion comprises one of a convex portion and a concave portion, and the second positioning portion comprises the other of the convex portion and the concave portion.

9. The mold fixing structure of claim 7, wherein the mold comprises a punch that is formed on a side of the mold opposite the mold mounting surface and aligned with the second positioning portion of the mold.

10. The mold fixing structure of claim 4, wherein the mold comprises a groove including a first groove portion having a first width and a second groove portion having a second width less than the first width, and wherein the mold supporting body is inserted into the mold by inserting the flange and the bearing into the first groove portion, and the bearing supports the mold inside the first groove portion.

11. The mold fixing structure of claim 10, wherein a diameter of the flange is greater than a diameter of the second groove portion.

12. The mold fixing structure of claim 10, wherein the bearing supports the mold by contacting an upper wall of the first groove portion so that the flange is separated from the upper wall.

13. The mold fixing structure of claim 10, wherein the shaft comprises:

a first shaft portion having a first diameter and around which the bearing rotates; and a second shaft portion having a second diameter greater than the first diameter, the second shaft portion being formed in second groove portion.

14. The mold fixing structure of claim 13, wherein the bearing supports the mold so as to separate the second shaft portion from an upper wall of the second groove portion.

15. A mold fixing structure for fixing a mold having a punch or a die to a mold mounting surface of a press machine, the mold fixing structure comprising:

a plurality of mold supporting bodies disposed in a mold mounting surface, each of the mold supporting bodies comprising:

a shaft portion that is disposed to protrude perpendicularly from the mold mounting surface so as to be movable forward and backward;

a flange portion that is provided on a front end side of the shaft portion so as to extend in a direction perpendicular to an axis of the shaft portion;

a bearing portion that is provided further on the front end side of the shaft portion from the flange portion, the bearing portion being larger in outer diameter than the flange portion; and a mold supported by the bearing portion of each of the mold supporting bodies in a layout in which a part of the mold is located above the bearing portion and at a lateral side of the flange portion on a side of the mold mounting surface, so that the mold is fixed to the mold mounting surface and released from being fixed thereto in accordance with forward and backward movement of the shaft portion.

16. The mold fixing structure according to claim 15, wherein a groove portion having a T-shape in section and extending linearly is formed in a surface of the mold opposed to the mold mounting surface, so that the mold is supported in a state where a front end portion of one of the mold supporting bodies, including the flange portion and the bearing portion thereof, is fitted into the groove portion.

17. The mold fixing structure according to claim 16, wherein a plurality of the groove portions are formed in parallel in the mold so that the mold is supported in a state where a plurality of front end portions of the mold supporting bodies are fitted into the groove portions respectively.

18. The mold fixing structure according to claim 15, wherein a positioning convex portion or a positioning concave portion is provided in a surface of the mold opposed to the mold mounting surface, and a positioning concave portion or a positioning convex portion is provided in the mold mounting surface, so that the convex portion and the concave portion are fitted to each other, thereby positioning the mold when the mold approaches the mold mounting surface.

19. The mold fixing structure according to claim 16, wherein a positioning convex portion or a positioning concave portion is provided in a surface of the mold opposed to the mold mounting surface, and a positioning concave portion or a positioning convex portion is provided in the mold mounting surface, so that the convex portion and the concave portion are fitted to each other, thereby positioning the mold when the mold approaches the mold mounting surface.

20. The mold fixing structure according to claim 17, wherein a positioning convex portion or a positioning concave portion is provided in a surface of the mold opposed to the mold mounting surface, and a positioning concave portion or a positioning convex portion is provided in the mold mounting surface, so that the convex portion and the concave portion are fitted to each other, thereby positioning the mold when the mold approaches the mold mounting surface.

* * * * *